US008277110B2

(12) United States Patent
Lee et al.

(10) Patent No.: US 8,277,110 B2
(45) Date of Patent: Oct. 2, 2012

(54) MICROMIXER BIOCHIP

(75) Inventors: Gwo-Bin Lee, Tainan (TW); Sung-Yi Yang, Tainan (TW)

(73) Assignee: National Cheng Kung University, Tainan (TW)

( * ) Notice: Subject to any disclaimer, the term of this patent is extended or adjusted under 35 U.S.C. 154(b) by 526 days.

(21) Appl. No.: 12/588,194

(22) Filed: Oct. 7, 2009

(65) Prior Publication Data

US 2010/0246315 A1 Sep. 30, 2010

(30) Foreign Application Priority Data

Mar. 30, 2009 (TW) ..... 98110432 A

(51) Int. Cl.
*B01F 5/02* (2006.01)

(52) U.S. Cl. ..... 366/134; 366/131; 366/165.1; 366/275

(58) Field of Classification Search ..... 366/131, 366/134, 165.1, 165.4, 165.5, 275
See application file for complete search history.

(56) References Cited

U.S. PATENT DOCUMENTS

| | | | | |
|---|---|---|---|---|
| 3,588,054 | A * | 6/1971 | Ljungberg et al. | 366/69 |
| 3,656,716 | A * | 4/1972 | Ljungerg et al. | 366/76.1 |
| 6,331,073 | B1 * | 12/2001 | Chung | 366/341 |
| 2003/0123322 | A1 * | 7/2003 | Chung et al. | 366/165.1 |
| 2003/0165079 | A1 * | 9/2003 | Chen et al. | 366/165.1 |

* cited by examiner

*Primary Examiner* — David Sorkin
(74) *Attorney, Agent, or Firm* — Bacon & Thomas, PLLC

(57) ABSTRACT

The present invention provides a micromixer biochip, comprising: a substrate having a surface; a fluidic channel layer disposed above the surface of the substrate, including a mixing chamber and a single-opening fluidic channel, wherein one end of the single-opening fluidic channel is closed and the other end of the single-opening fluidic channel connects to the mixing chamber, and a top portion of the single-opening fluidic channel is made of a flexible material; and an air chamber layer disposed above the top portion of the fluidic channel layer, including an air pore, at least one chamber, and an air channel connecting the chamber and the air pore, wherein the number and position of the air chamber correspond to the number and position of the single-opening fluidic channel of the fluidic channel layer.

21 Claims, 10 Drawing Sheets

MICROMIXER BIOCHIP

BACKGROUND OF THE INVENTION

1. Field of the Invention

The present invention relates to a micromixer biochip, and more particularly, to a micromixer biochip that mixes the fluids inside the mixing chamber by generating vortex flows.

2. Description of the Related Art

Fluid mixing is an essential procedure in the filed of biochemistry. Thus, to develop micromixers that are simple in design yet can achieve effective mixing within a short time has been an important issue for biochip researchers. Most of the conventional micromixers use passive methods to mix substances. For example, in such a conventional micromixer, more than two substances flowing inside the device are mixed through the use of a blocking or bending structure. This kind of mixing technique is not favorable for biochemical applications, since the mixing performance is generally poor and it consumes much time for substances to be completely mixed.

In recent years, more and more researches in the biology, chemical and medical fields are focusing on micrometer- and nanometer-scale particles. However, conventional micromixers generally consume great volume and tend to use large measuring cups, magnetic bars or magnetic rotational devices. As such, mixing substances placed in such large container through the rotation of the magnetic bars will consume a great amount of substances and much more time, and the product produced may demonstrate an uneven temperature distribution.

Thus, it is an objective of the present invention to provide a micromixer biochip that can mix small-scale substances rapidly, and moreover, the driving energy of the micromixer biochip to achieve effective mixing can be controlled.

SUMMARY OF THE INVENTION

In view of the drawbacks of conventional micromixers, it is an objective of the present invention to provide a micromixer biochip that mixes substances with active vortex flows. Therefore, drawbacks of a conventional micromixer utilizing passive mixing methods, such as poor mixing performance or requiring large volume samples, can be overcome.

To achieve the aforementioned objectives, a micromixer biochip of the present invention is provided, comprising: a substrate having a surface; a fluidic channel layer disposed above the surface of the substrate, including a mixing chamber and a single-opening fluidic channel, wherein one end of the single-opening fluidic channel is closed and the other end of the single-opening fluidic channel connects to the mixing chamber, the axis of the single-opening fluidic channel does not pass through the center of the mixing chamber, and a top portion of the single-opening fluidic channel is made of a flexible material; and an air chamber layer disposed above the top portion of the fluidic channel layer, including an air pore and an air chamber connecting to the air pore, wherein the number and position of the air chamber correspond to the number and position of the single-opening fluidic channel of the fluidic channel layer.

The present invention also provides a micromixer biochip, comprising: a substrate having a surface; a fluidic channel layer disposed above the surface of the substrate, including a mixing chamber and at least two single-opening fluidic channels, wherein one end of each single-opening fluidic channel is closed and the other end of each single-opening fluidic channel connects to the mixing chamber, the axis of each single-opening fluidic channel does not pass through the center of the mixing chamber, and the top portion of each single-opening fluidic channel is made of a flexible material; and an air chamber layer disposed above the fluidic channel layer, including an air pore, at least two air chambers connecting to the air pore, and an air channel connecting the at least two air chambers and the air pore, wherein the number and position of the air chambers correspond to the number and position of the single-opening fluidic channels of the fluidic channel layer.

During the operation of the micromixer biochip of the present invention, the top portion of the single-opening fluidic channel can be induced up-and-down deformations by frequently controlling the pressure inside the air chambers. Such up-and-down deformations of the top portion of the single-opening fluidic channel can introduce the fluid from the single-opening fluidic channel to the mixing chamber, and vice versa. In addition, since the axis of the single-opening fluidic channels does not pass through the center of the mixing chamber, the moving fluids can generate a vortex flow in the mixing chamber and accomplish the mixing effect.

DETAILED DESCRIPTION OF THE PREFERRED EMBODIMENTS

Figure 3:
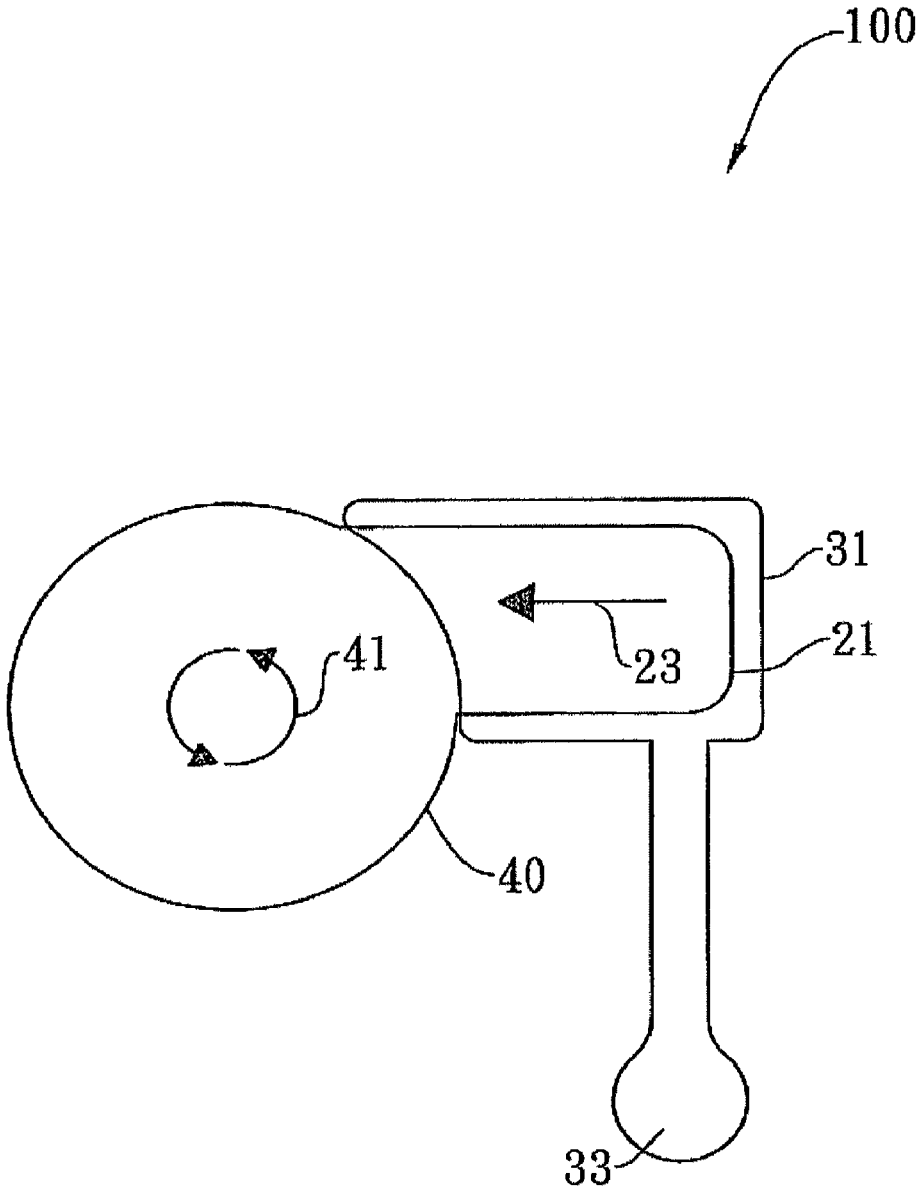
FIG. 3 is a top view showing a micromixer biochip of the present invention comprising one single-opening fluidic channel and one air chamber.
Figure 6:
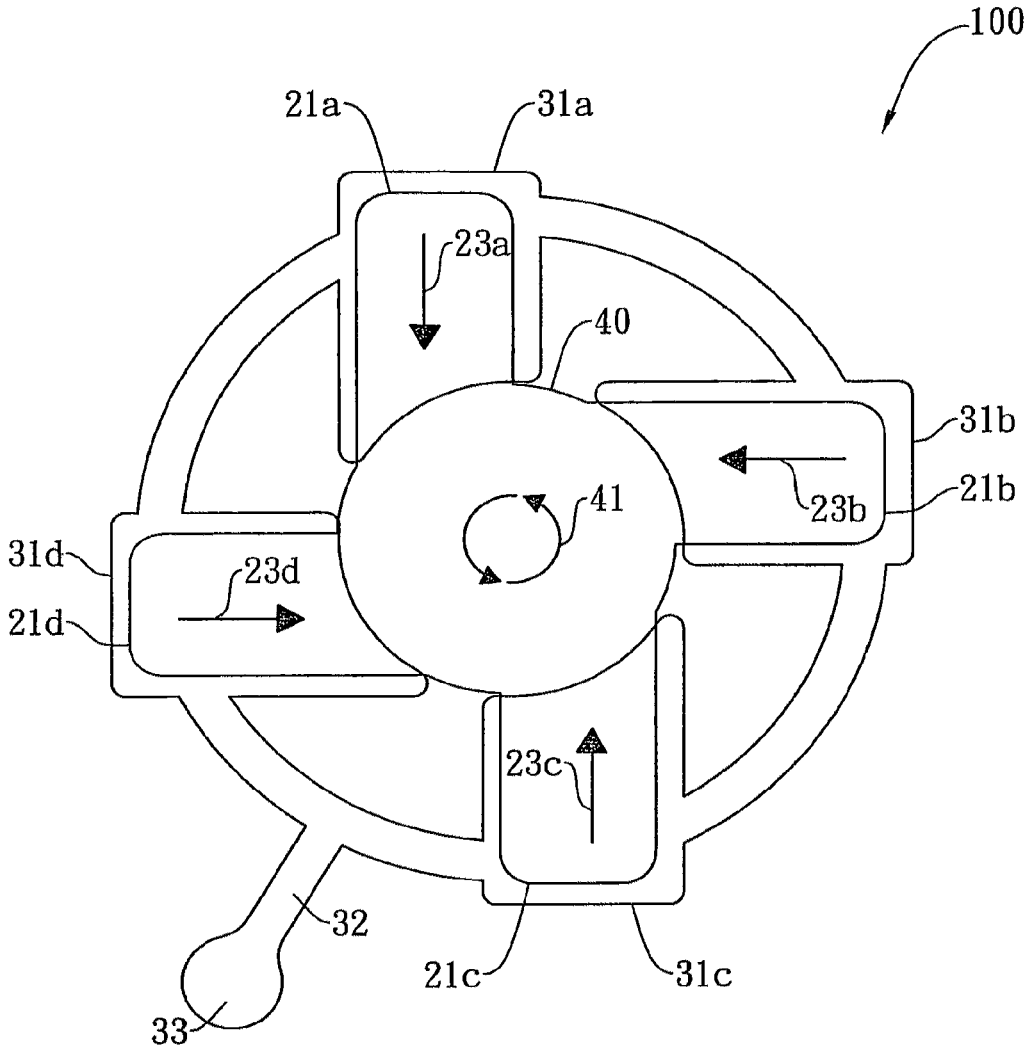
FIG. 6 is a top view showing, a micromixer biochip of the present invention comprising four single-opening fluidic channels and four air chambers.
Figure 7:
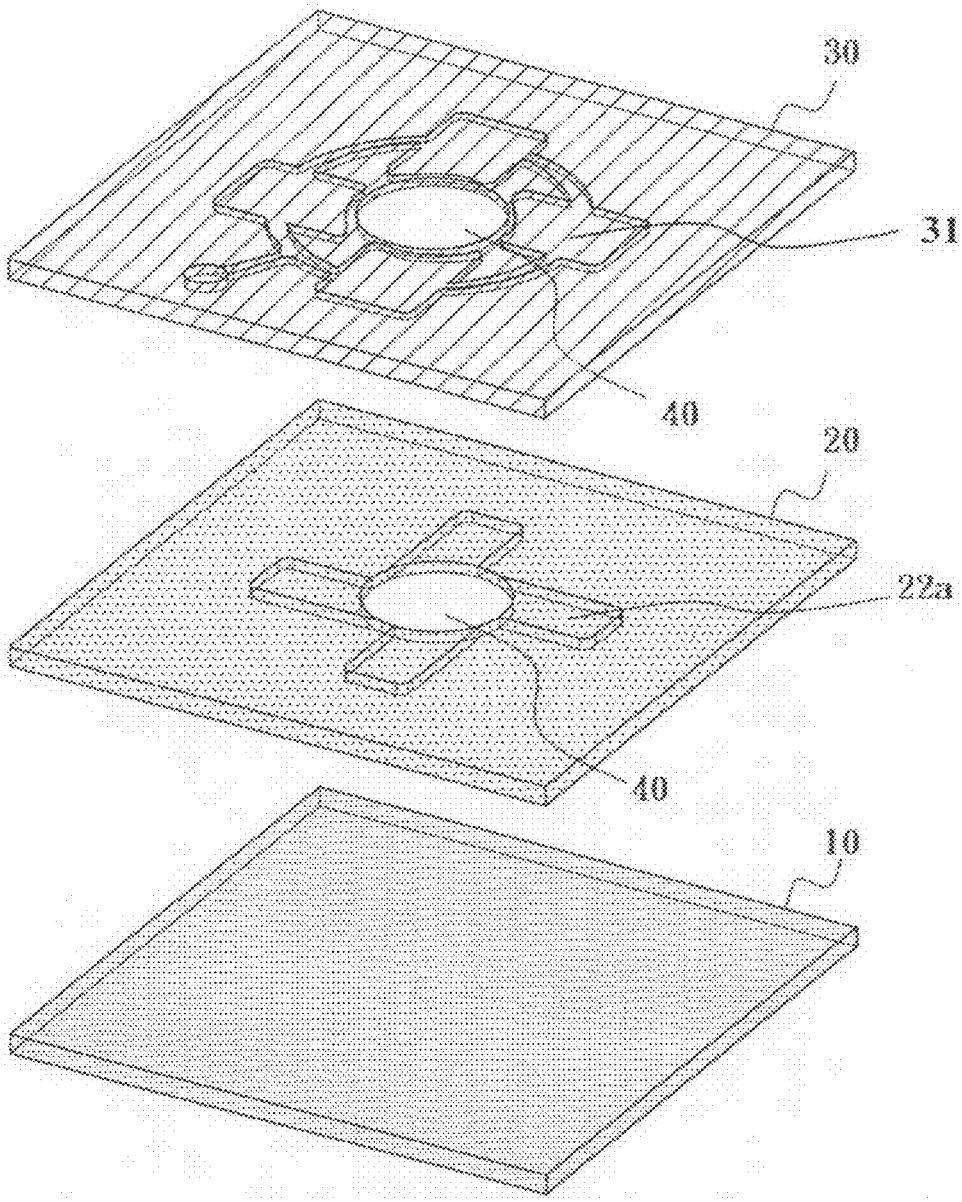
FIG. 7 shows the structure of each layer of a micromixer biochip of the present invention.

A micromixer biochip of the present invention has a three-layer structure (as shown in FIG. 7). FIGS. 3, 4, 5, and 6 are top views of the micromixer biochip made by the three-layer structure. Referring to FIG. 3, a schematic view illustrating the structure of a micromixer biochip 100 is shown. The micromixer biochip 100 comprises: a mixing chamber 40, a single-opening fluidic channel 21, an air chamber 31, and an air pore 33. One end of the single-opening fluidic channel 21 is closed, and the other end connects to the mixing chamber 40. The top portion (referring to component 22 in FIG. 1) of the single-opening fluidic channel 21 is made of a flexible material, and the air chamber 31 is disposed above the top portion of the fluidic channel layer.

The air pore 33 (as shown in FIGS. 1 and 2) of the micromixer biochip 100 is used as an opening through which air is injected to or extracted from the air chamber 31; that is, the positive or negative pressure state inside the air chamber can be formed by operating the air injecting to or extracting form the air pore 33. When the present invention is in use, air is driven to be injected to and extracted from the air chamber 31 through the air pore 33 at a frequency, thereby inducing the deformation and recovery process of the top portion 22 of the single-opening fluidic channel to occur at a frequency. The above deformation and recovery process induce the air pressure variation of the single-opening fluidic channel 21, further causing the flow of the fluids inside the micromixer biochip 100. Then, a vortex flow 41 is thus formed inside the mixing chamber 40 to reach mixing performance.

Figure 1A:
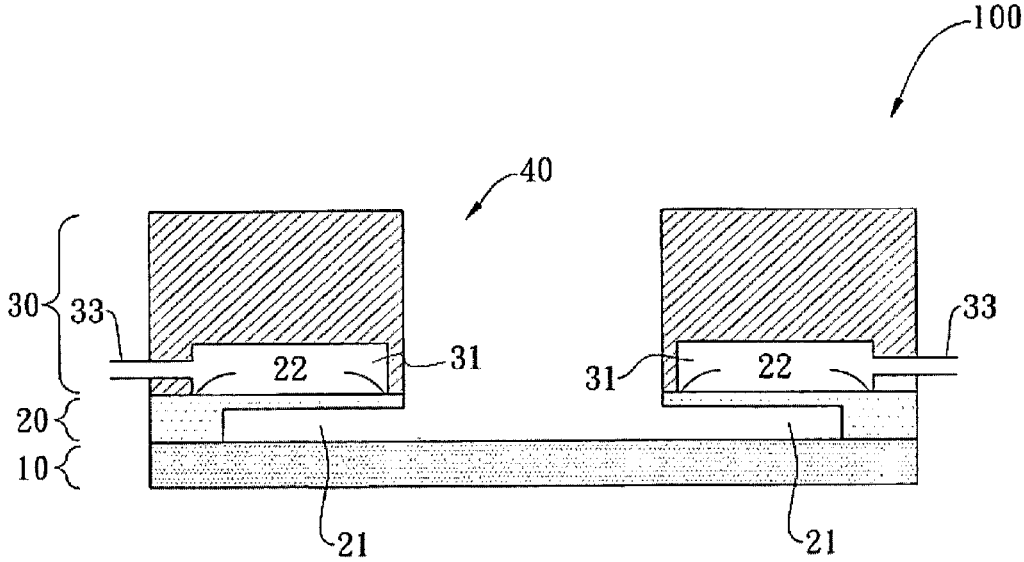
FIG. 1A is a cross-sectional view showing the structure of a micromixer biochip of the present invention when air has not been injected thereto (under positive pressure).
Figure 1B:
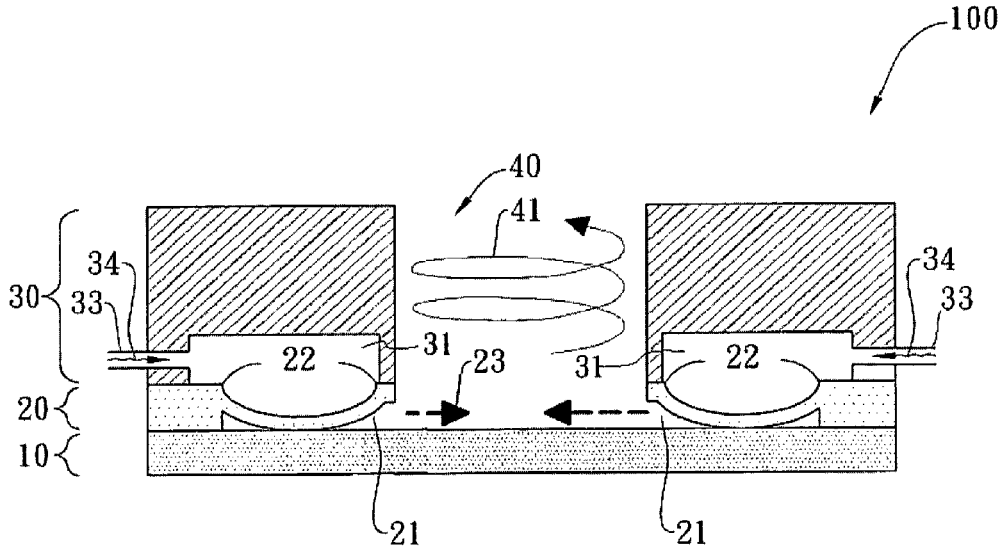
FIG. 1B is a cross-sectional view showing the structure of a micromixer biochip of the present invention when air has been injected thereto (under positive pressure).

Referring to FIGS. 1A and 1B, when the present invention is used to mix substances by forming a positive state inside the air chamber 31, the air is first injected into the air chamber 31 through the air pore 33 in a motion direction 34. Since the top portion 22 of the single-opening fluidic channel is made of a flexible material, as the pressure inside the air chamber 31 increases, the top portion 22 will induce a downward deformation. Such deformation pushes the substances in the single-opening fluidic channel 21 to flow into the mixing chamber 40, thus forming a vortex flow 41 inside the mixing chamber 40.

Figure 2A:
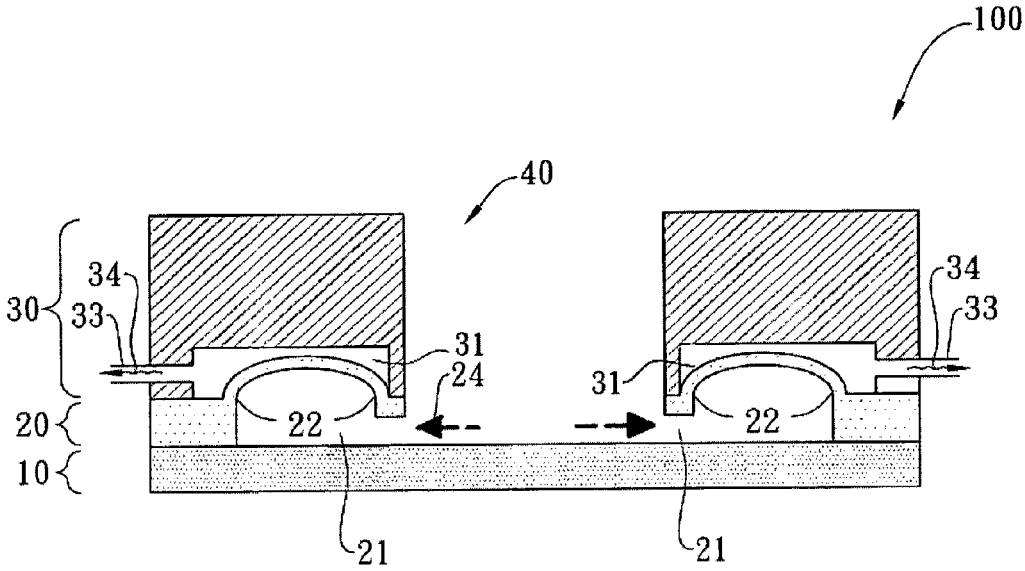
FIG. 2A is a cross-sectional view showing the structure of a micromixer biochip of the present invention when air has been extracted therefrom (under negative pressure).
Figure 2B:
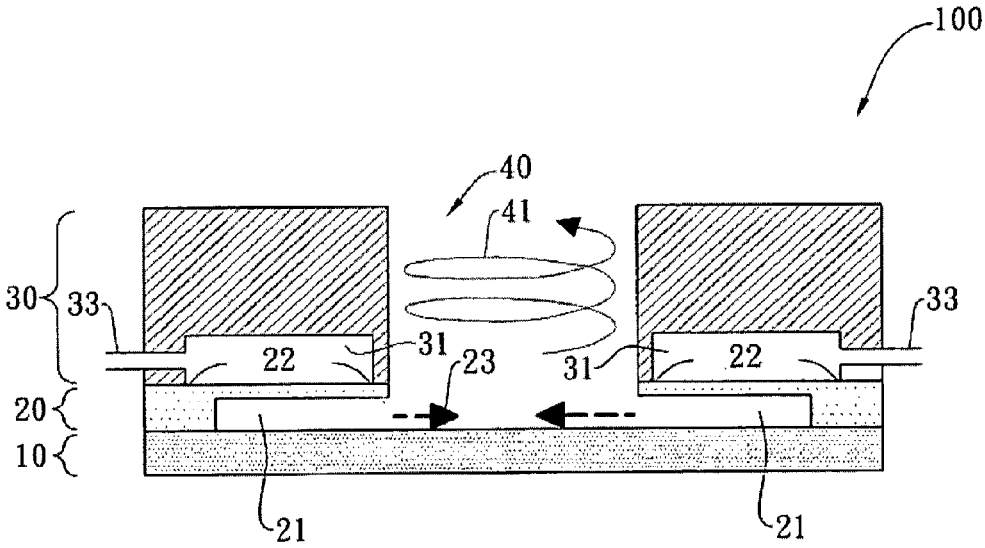
FIG. 2B is a cross-sectional view showing the structure of a micromixer biochip of the present invention when air has not been extracted therefrom (under negative pressure).

Referring to FIGS. 2A and 2B, when the present invention is used to mix substances by forming a negative state inside the air chamber 31, air is first extracted from the air chamber 31 through the air pore 33 in a motion direction 34. Since the top portion 22 of the single-opening fluidic channel is made of a flexible material, as the pressure inside the air chamber 31 decreases, the top portion 22 will induce a upward deformation. Such deformation pushes the substances in the mixing chamber 40 to flow into the single-opening fluidic channel 21. When air extraction is stopped, the top portion 22 of the single-opening fluidic channel will recover to its original position, thereby causing the substances in the single-opening fluidic channel 21 flow into the mixing chamber 40 and form a vortex flow 41.

In a micromixer biochip of the present invention, the top portion 22 of the single-opening fluidic channel is made of a flexible material; thus, when the pressure inside the air chamber increases, a downward deformation can be induced that pushes the fluids in the single-opening fluidic channel to flow into the mixing chamber. Or alternatively, an upward deformation can be induced when the pressure inside the air chamber decreases, and as the top portion of the single-opening fluidic channel recovers its position, the fluids are pushed into the mixing chamber. The flexible material suitable for the present invention is preferably, but not limited to, polydiamethylsiloxane (PDMS) or food grade silica gel (such as Elastosil R401/50).

The substrate of the micromixer biochip is made of a rigid material, so that the substrate can form a main supporting structure for the micromixer biochip. The substrate is made of a transparent rigid material in preferred embodiments; as a result, the mixing condition of the substances inside the micromixer biochip can be observed using other monitoring devices. The rigid material suitable for the substrate of the present invention includes, but not limited to, glass and rigid plastic.

The fluidic channel layer and the air chamber layer of the micromixer biochip may be made of the same or different materials. Both of these two layers are preferably made of flexible materials such as, but not limited to, polydiamethylsiloxane (PDMS). Preferably, except for the top portion of the single-opening fluidic channel, the fluidic channel layer and the air chamber layer are made of the same or different rigid materials such as, but not limited to, glass or rigid plastic mentioned above.

During the operation of the micromixer biochip of the present invention, the amount of air being injected to/extracted from the air pore is supplied at certain driving frequency so as to produce pressure variations, and the driving frequency is dependent on the desired mixing performance. Such pressure variations induce rapid up-and-down deformations of the air chamber and its corresponding top portion of the single-opening fluidic channel. As a result, the substances to be mixed are forced to move in and out of the mixing chamber rapidly. A vortex flow is then generated, accomplishing the mixing effect.

Figure 4:
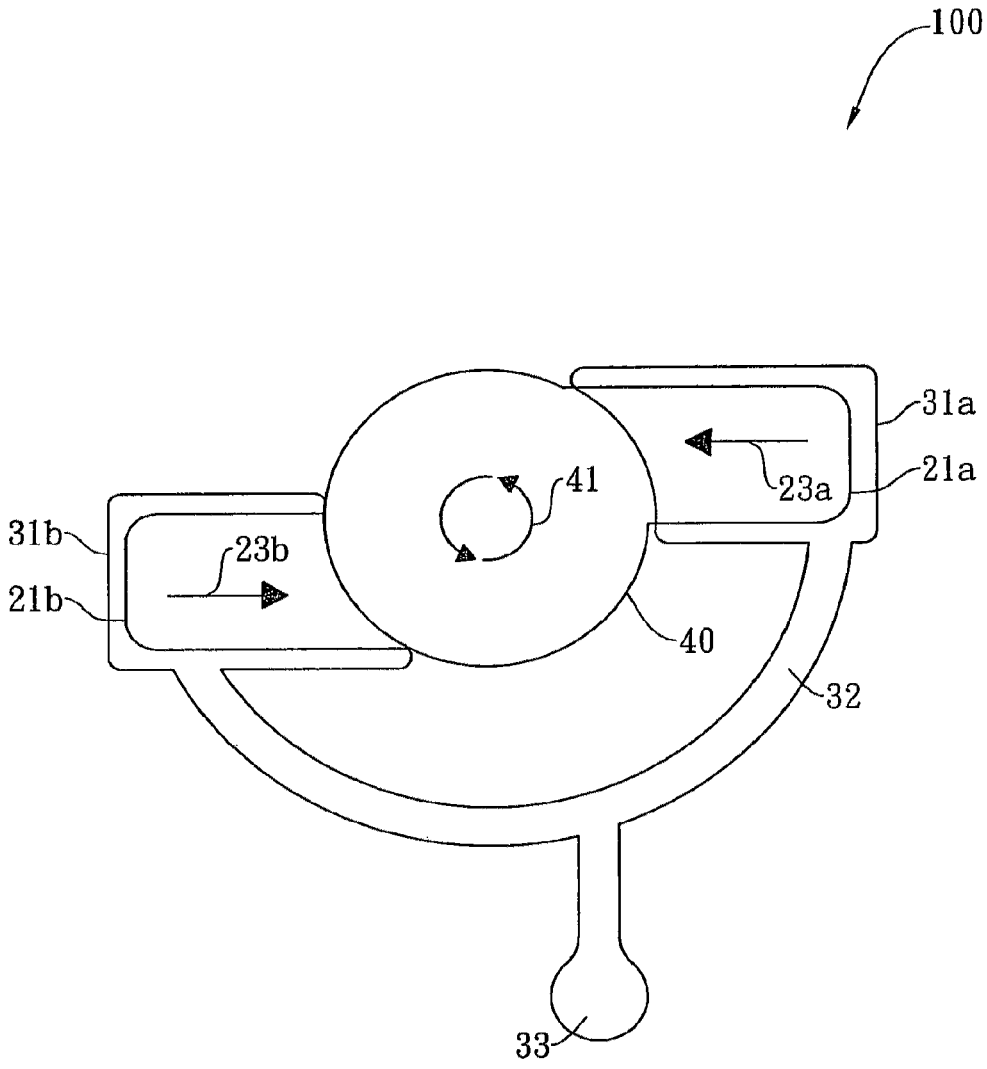
FIG. 4 is a top view showing a micromixer biochip of the present invention comprising two single-opening fluidic channels and two air chambers.

The present invention also provides a micromixer biochip having two single-opening fluidic channels, as shown in FIG. 4. The micromixer biochip 100 shown in FIG. 4 comprises a mixing chamber 40, two single-opening fluidic channels 21*a* and 21*b*, two air chambers 31*a* and 31*b*, an air channel 32, and an air pore 33. One end of each single-opening fluidic channel 21*a*, 21*b* is closed, and the other end connects to the mixing chamber 40. Moreover, the axis of each single-opening fluidic channel 21*a*, 21*b* does not pass through the center of the mixing chamber 40. The top portion 22 (as shown in FIGS. 1 and 2) of each single-opening fluidic channel 21*a*, 21*b* is made of a flexible material. The air chambers 31*a* and 31*b* are located above the single-opening fluidic channel 21*a* and 21*b* respectively, and the air channel 32 connects the two air chambers. The single-opening fluidic channels 21*a* and 21*b* of the micromixer biochip 100 are arranged like the blades of a propeller.

The arrangement of the single-opening fluidic channels that looks like propeller blade, wherein the single-opening fluidic channels may include two or more single-opening fluidic channels connecting to the mixing chamber. With this kind of arrangement, the substances to be mixed are allowed to generate vortex flows that do not offset each other as the substances are pushed from each single-opening fluidic channel into the mixing chamber. For example, the two single-opening fluidic channels may be arranged in a pattern as shown in FIG. 4.

It can be easily understood that when a plurality of the single-opening fluidic channels are configured to connect to the mixing chamber, the plurality of the single-opening fluidic channels may be arranged evenly around the mixing chamber, or may be arranged unevenly in accordance with the configuration of other components. However, the arrangement should conform to the principle described above; that is, the vortex flows generated do not offset each other as the substances are pushed from each single-opening fluidic channel into the mixing chamber.

In a micromixer biochip of the present invention, the width of the single-opening fluidic channel or of the corresponding air chamber is preferably greater than the radius of the mixing chamber, so that as the fluids in the single-opening fluidic channel flow into the mixing chamber, a greater pouring force can be generated that creates a more violent vortex flow to accomplish better mixing performance.

Moreover, it can be easily understood that the number of single-opening fluidic channel does not affect the selection of materials used for the micromixer biochip.

During the operation of the micromixer biochip of the present invention, by forming a positive or negative pressure state inside the air chamber at certain frequency, the chamber and the corresponding top portion of the single-opening fluidic channel undergo a deformation and recovery process continuously, thereby causing the fluids in the mixing chamber to generate a vortex flow. The method for forming a positive or negative pressure state inside the air chamber at certain frequency is as follows:

FIGS. 1A and 1B show the state of each component when the air chamber 31 is made to form a positive pressure environment. FIG. 1A shows the state when air has not been injected to the air pore of a micromixer biochip 100 (including two single-opening fluidic channels as in the embodiment shown in FIG. 4), and FIG. 1B shows the state when air has been injected to the air pore of the micromixer biochip 100. When there are fluids in the mixing chamber 40 of the micromixer biochip 100 and air is injected to the air chamber 31 through the air pore 33, the corresponding top portion 22 of the single-opening fluidic channel will deform due to an increase of pressure inside the air chamber 31. Thus, the substances to be mixed are pushed from the single-opening fluidic channel to the mixing chamber 40 in a direction like arrow 23. The process is repeated in a way that air is injected to and extracted from the air chamber 31 continuously at a certain frequency, thereby forming a vortex flow 41 inside the mixing chamber of the micromixer biochip 100.

FIGS. 2A and 2B show the state of each component when the air chamber 31 is made to form a negative pressure environment. FIG. 2A shows the state when air has been extracted from the air chamber 31 through the air pore 33 of a micromixer biochip 100 (including two single-opening fluidic channels as in the embodiment shown in FIG. 4), and FIG. 2B shows the state when the air extraction from the air chamber 31 of the micromixer biochip 100 has been stopped. When there are fluids in the mixing chamber 40 and air is extracted from the air chamber 31, a negative pressure environment is formed inside the air chamber 31. Then, the corresponding top portion 22 of the single-opening fluidic channel will deform due to a decrease of pressure inside the air chamber 31, thus pushing the fluids to flow from the mixing chamber 40 to the single-opening fluidic channel (as shown in FIG. 2A) in a direction like arrow 24. When the air chamber 31 ceases to form a negative pressure environment, the corresponding top portion of the single-opening fluidic channel will recover its original position. As a result, the substances to be mixed are pushed from the single-opening fluidic channel to the mixing chamber (as shown in FIG. 2B) in a direction like arrow 23. The process is repeated in a way that air is extracted from and injected to the air chamber 31 continuously at a certain frequency, thereby forming a vortex flow 41 inside the mixing chamber of the micromixer biochip 100.

Figure 5:
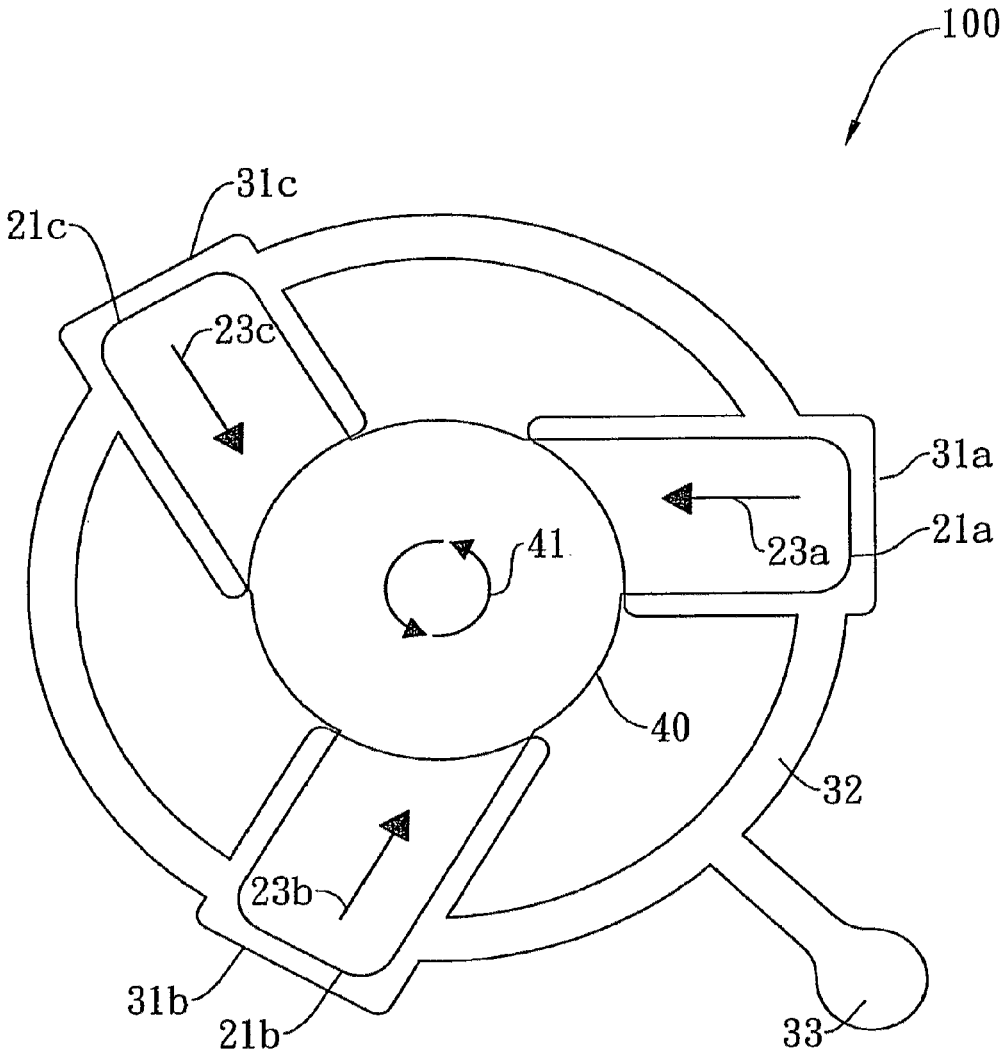
FIG. 5 is a top view showing a micromixer biochip of the present invention comprising three single-opening fluidic channels and three air chambers.

FIGS. 5 and 6 schematically show micromixer biochips of the present invention including three and four single-opening fluidic channels respectively. The operating steps of these two micromixer biochips may refer to those of the micromixer biochip in FIG. 4.

Now, an embodiment of the present invention will be described below, which is used to further illustrate the advantages rather than limit the scope of claims of the present invention.

Example 1

Figure 8:
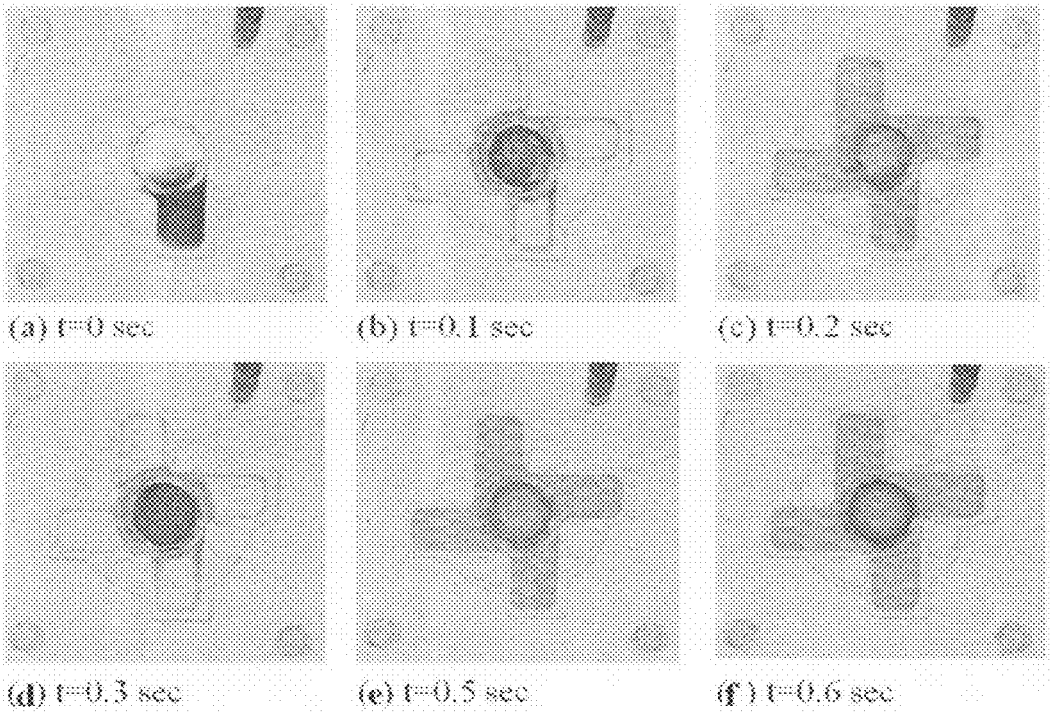
FIG. 8 shows a series of photographs for mixing process at different times.
Figure 9:
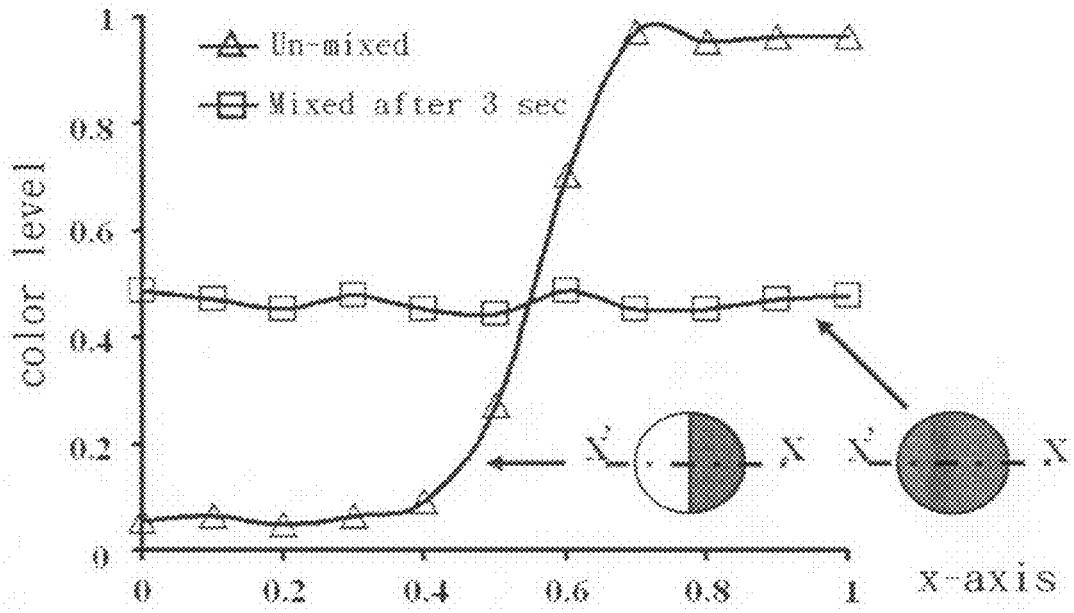
FIG. 9 is a chart showing the mixing efficiencies of a micromixer biochip of the present invention.
Figure 10:
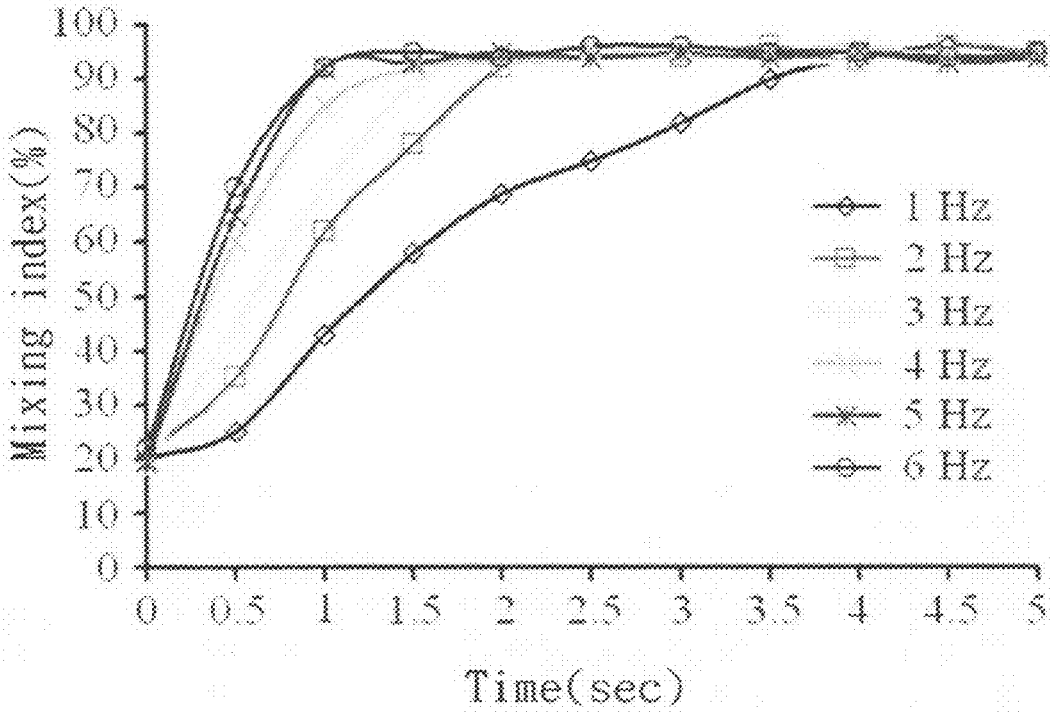
FIG. 10 is a chart showing the mixing efficiencies of a micromixer biochip of the present invention at different frequencies of the pneumatic driving pressure.

Mixing Efficiency of a Micromixer Biochip Including Four Single-Opening Fluidic Channels To evaluate the mixing performance of a micromixer biochip of the present invention, two fluid samples, including red ink and deionized water, are used to demonstrate the mixing process in this embodiment. FIGS. 8, 9, and 10 are referred to for illustrating the mixing process; FIGS. 1 and 7 are referred to for identifying the component numerals of the micromixer biochip.

FIG. 8 shows a series of photographs for verifying the mixing performance of a micromixer biochip that includes four single-opening fluidic channels; the performance of mixing the deionized water and red ink samples with the same applied pressure at different times are observed. The circular mixing chamber is first loaded with deionized water of 40 μL, and one single-opening fluidic channel is loaded with red ink of 2 μL. The air being injected to the micromixer biochip has an applied pressure of 10 psi and a driving frequency of 10 Hz. A high-speed charge-coupled device (CCD) and a microscope are used to observe the mixing performance of the red ink and deionized water inside the micromixer biochip; the images are shown in FIG. 8 (*a*) through 8 (*f*). In FIG. 8(*a*), red ink has just been added into one single-opening fluidic channel 21. FIG. 8(*b*) shows the image inside the micromixer biochip after the red ink has been pipetted for 0.1 second; compressed air is now being injected to the air channel 32 and induces the deformation of top portion 22 of the single-opening fluidic channel 21, thereby pushing the fluids in the single-opening fluidic channel 21 to flow into the mixing chamber 40. FIG. 8(*c*) shows the image inside the micromixer biochip after the red ink has been added for 0.2 second; the injection of compressed air is stopped and the top portion 22 of the single-opening fluidic channel 21 recovers its original position. Each single-opening fluidic channel 21 is in a negative pressure state now, causing the fluids to flow into each single-opening fluidic channel 21. FIG. 8(*d*) shows the image inside the micromixer biochip after the red ink has been pipetted for 0.3 second; compressed air is now being injected to the air channel 32 and induces the deformation of top portion 22 of each single-opening fluidic channel 21, thereby pushing the fluids in each single-opening fluidic channel 21 to flow into the mixing chamber 40. FIG. 8(*e*) shows the image inside the micromixer biochip after the red ink has been pipetted for 0.5 second; the injection of compressed air is stopped and the top portion 22 of each single-opening fluidic channel 21 recovers its original position. Each single-opening fluidic channel 21 is in a negative pressure state now, causing the fluids to flow back into each single-opening fluidic channel 21. FIG. 8(*f*) shows the image inside the micromixer biochip after the red ink has been pipetted for 0.6 second; from the color level shown in this image, it is found that the red ink and the deionized water have been mixed completely.

FIG. 9 shows the mixing performance of the micromixer biochip including four single-opening fluidic channels at 1 second after the beginning of the mixing process by using the deionized water and the red ink. The experimental steps are the same as those described above. During the experiment, a high-speed charge-coupled device (CCD) and a microscope are used to observe the mixing condition of the red ink and deionized water inside the micromixer biochip; then, an image processing software (Photoshop) is used to compare the fluids before the mixing process begins with the fluids 1 second after the mixing process begins and analyze their distributions of color level. In FIG. 9, the x-axis represents the coordinate of a line cutting across the center of the circular mixing chamber (0 to 1 represent the left end to right end of the circular mixing chamber). The y-axis in FIG. 9 represents value of the color level: the color level of the deionized water is defined as 0, and the color level of the red ink is defined as 1. When the deionized water and the red ink are completely mixed, the color level of the mixed solution is around 0.5. The △ symbols represent the color-level distribution from the left to right end of the mixing chamber when the fluids have not been mixed yet; the ⊟ symbols represent the color-level distribution from the left to right end of the mixing chamber after the mixing of fluids begins. FIG. 9 shows that when the fluids have not been mixed yet, the left end and the right end of the mixing chamber have a greater difference in color level. However, 1 second after the beginning of the mixing process, the left end and the right end of the mixing chamber have a smaller difference in color level, meaning that the deionized water and the red ink inside the micromixer biochip have almost been mixed completely.

FIG. 10 shows the mixing performance of the micromixer biochip including four single-opening fluidic channels at different driving frequencies in the experiment using the deionized water and the red ink. The process are the same as those described above, except that the compressed air being injected to the micromixer biochip is supplied at different frequencies ranging from 1-6 Hz while the applied pressure is fixed at 10 psi. During the experiment, a high-speed charge-coupled device (CCD) and a microscope are used to observe the mixing condition of the red ink and deionized water inside the micromixer biochip; then, an image processing software (Photoshop) is used to compare the fluids before the mixing process begins with the fluids 5 seconds after the mixing process begins and analyze their distributions of color level. The x-axis of FIG. 10 represents the mixing time (0 to 5 seconds from left to right), and the y-axis represents the mixing index that is defined as follows:

$$\sigma(x) = \left(1 - \frac{\int_0^h |C - C_\infty dy|}{\int_0^h |C_0 - C_\infty| dy}\right) \times 100\%$$

where C represents the color level, $C_0$ represents the initial color level of the unmixed fluids, and $C_\infty$ represents the color level after the mixing begins; an index with a greater value from 0 to 100 means a better mixing efficiency. The result in FIG. 10 shows that when the air is supplied at a driving frequency of 1 Hz, it takes about more than 4 seconds to reach a mixing index of 95%, and that when the driving frequency is increased to 6 Hz, a mixing index of 95% can be reached within 1 second. From the above, it is found that when the air is supplied at a higher driving frequency, less time is needed to reach the same mixing performance.

In sum, with a micromixer biochip of the present invention, the user is allowed to actively adjust the driving frequency for supplying the compressed air. The compressed air injected to the micromixer biochip can induce deformation of the top portion of the single-opening fluidic channel, thereby pushing the substances to flow back and forth between the single-opening fluidic channel and the mixing chamber rapidly. Moreover, since the axis of the single-opening fluidic channel does not pass through the center of the mixing chamber, the substances inside the mixing chamber can generate a vortex flow and achieve effective mixing. Compared to a conventional micromixer of passive device, the micromixer biochip of the present invention can achieve desired mixing performance with less volume consumed by generating vortex flows actively.

Other Embodiments

All of the features disclosed in this specification may be combined in any combination. Each feature disclosed in this specification may be replaced by an alternative feature serving the same, equivalent, or similar purpose. Thus, unless expressly stated otherwise, each feature disclosed is only an example of a generic series of equivalent or similar features.

The preferred embodiments of the present invention have been disclosed in the examples. However the examples should not be construed as a limitation on the actual applicable scope of the invention, and as such, all modifications and alterations without departing from the spirits of the invention and appended claims, including the other embodiments shall remain within the protected scope and claims of the invention.

What is claimed is:

1. A micromixer biochip, comprising:

a substrate having a surface;

a fluidic channel layer disposed above the surface of the substrate, including a mixing chamber and a single-opening fluidic channel, wherein one end of the single-opening fluidic channel is closed and the other end of the single-opening fluidic channel connects to the mixing chamber, the axis of the single-opening fluidic channel does not pass through the center of the mixing chamber, and a top portion of the single-opening fluidic channel is made of a flexible material; and an air chamber layer disposed above the top portion of the fluidic channel layer, including an air pore and an air chamber connecting to the air pore, wherein the number and position of the air chamber correspond to the number and position of the single-opening fluidic channel of the fluidic channel layer.

2. The biochip of claim 1, wherein the width of the single-opening fluidic channel or of the corresponding air chamber is greater than the radius of the mixing chamber.

3. The biochip of claim 1, wherein the flexible material of the top portion of the single-opening fluidic channel is polydiamethylsiloxane (PDMS) or food grade silica gel.

4. The biochip of claim 1, wherein the substrate is made of a rigid material.

5. The biochip of claim 4, wherein the rigid material is glass or rigid plastic.

6. The biochip of claim 1, wherein the flexible materials of the fluidic channel layer and the air chamber layer are the same or different.

7. The biochip of claim 6, wherein the flexible materials are polydiamethylsiloxane (PDMS) or food grade silica gel.

8. The biochip of claim 1, wherein except for the top portion of the single-opening fluidic channel, the fluidic channel layer and the air chamber layer are made of the same or different rigid materials.

9. The biochip of claim 8, wherein the rigid materials are glass or rigid plastic.

10. A method of using the biochip of claim 1 for mixing substances, including the steps of:

(a) providing a biochip of claim 1;

(b) loading substances to be mixed into the mixing chamber;

(c) forming a positive or negative pressure state inside the air chamber to induce deformation and sequential recovery of the top portion of the corresponding single-opening fluidic channel;

(d) repeating the step (c) to cause the substances to form a vortex flow, such that the substances are mixed in the mixing chamber.

11. The method of claim 10, wherein the positive pressure state is formed by injecting air to the air chamber to induce a downward deformation of the top portion of the corresponding single-opening fluidic channel.

12. The method of claim 10, wherein the negative pressure state is formed by extracting air from the air chamber to induce an upward deformation of the top portion of the corresponding single-opening fluidic channel.

13. A micromixer biochip, comprising:

a substrate having a surface;

a fluidic channel layer disposed above the surface of the substrate, including a mixing chamber and at least two single-opening fluidic channels, wherein one end of each single-opening fluidic channel is closed and the other end of the each single-opening fluidic channel connects to the mixing chamber, the axis of each single-opening fluidic channel does not pass through the center of the mixing chamber, and the top portion of each single-opening fluidic channel is made of a flexible material; and an air chamber layer disposed above the fluidic channel layer, including an air pore, at least two air chambers connecting to the air pore, and an air channel connecting the at least two air chambers and the air pore, wherein the number and position of the air chambers correspond to the number and position of the single-opening fluidic channels of the fluidic channel layer, and wherein the at least two single-opening fluidic channels are arranged like the blades of a propeller.

14. The biochip of claim 13, wherein the width of each single-opening fluidic channel or of each corresponding air chamber is greater than the radius of the mixing chamber.

15. The biochip of claim 13, wherein the flexible material of the top portion of the single-opening fluidic channel is polydiamethylsiloxane (PDMS) or food grade silica gel.

16. The biochip of claim 13, wherein the substrate is made of a rigid material.

17. The biochip of claim 16, wherein the rigid material is glass or rigid plastic.

18. The biochip of claim 13, wherein the flexible materials of the fluidic channel layer and the air chamber layer are the same or different.

19. The biochip of claim 18, wherein the flexible materials are polydiamethylsiloxane (PDMS) or food grade silica gel.

20. The biochip of claim 13, wherein except for the top portion of the single-opening fluidic channel, the fluidic channel layer and the air chamber layer are made of the same or different rigid materials.

21. The biochip of claim 20, wherein the rigid materials are glass or rigid plastic.

* * * * *